US005876237A

United States Patent [19]

Patel et al.

[11] Patent Number: 5,876,237

[45] **Date of Patent: *Mar. 2, 1999**

[54] ELECTRICAL CONNECTOR

[75] Inventors: Arvind Patel, Naperville; William R. Lenz, Lockport; Ken Grambley, Elburn; Jack J. Schafer, LaGrange; Daniel M. Prescott, Glen Ellyn; Charles T. Walsh, Elgin, all of Ill.

[73] Assignee: Molex Incorporated, Lisle, Ill.

[ * ] Notice: Under 35 U.S.C. 154(b), the term of this patent shall be extended for 478 days.

[21] Appl. No.: 491,458

[22] Filed: Jun. 16, 1995

Related U.S. Application Data

[63] Continuation-in-part of Ser. No. 241,383, May 11, 1994, Pat. No. 5,453,028.

[51] Int. Cl.[6] ..... H01R 4/24

[52] U.S. Cl. ..... 439/441

[58] Field of Search ..... 439/842, 843, 439/438–441, 943, 636, 637

[56] References Cited

U.S. PATENT DOCUMENTS

| | | | |
|---|---|---|---|
| 4,235,500 | 11/1980 | Belopavlovich et al. | 339/176 MF |
| 4,792,307 | 12/1988 | Stewart, Sr. | 439/26 |
| 5,244,414 | 9/1993 | Peloza | 435/567 |
| 5,338,230 | 8/1994 | Bryce | 439/629 |
| 5,403,209 | 4/1995 | Lytle | 439/682 |
| 5,494,456 | 2/1996 | Kozel et al. . | |

FOREIGN PATENT DOCUMENTS

| | | |
|---|---|---|
| 4109563 | 4/1992 | Japan . |

*Primary Examiner*—Paula Bradley
*Assistant Examiner*—Tho Dac Ta
*Attorney, Agent, or Firm*—Stephen Z. Weiss

[57] ABSTRACT

An electrical connector includes a dielectric housing having a terminal-receiving passage for insertion thereinto of a terminal in a given insertion direction. The terminal includes a spring contact arm at least in part projecting into the passage for engagement by an appropriate mating contact element. The terminal further includes an engagement arm projecting into the passage behind the spring contact arm at a location to provide an engagement shoulder for an insertion tool which forces the terminal into the terminal-receiving passage of the housing.

5 Claims, 5 Drawing Sheets

ELECTRICAL CONNECTOR

RELATED APPLICATION

This is a continuation-in-part of application Ser. No. 08/241,383, filed May 11, 1994 now U.S. Pat. No. 5,453,028 and assigned to the assignee of the present invention.

FIELD OF THE INVENTION

This invention generally relates to the art of electrical connectors and, particularly, to an electrical connector system which includes a unique terminal configuration.

BACKGROUND OF THE INVENTION

Generally, electrical connectors include a dielectric housing mounting a plurality of conductive terminals for making electrical connection between a pair of electrical devices. For instance, an electrical connector may interconnect a conductor of an electrical wire to a circuit trace on a printed circuit board. Electrical connectors have been provided in a myriad of designs and constructions.

The electrical terminals of such connectors also are provided in a myriad of different configurations. For instance, every terminal must have a contact portion or portions for engaging the electrical device or devices to which the terminal is terminated or between which the terminal is interconnected. For instance, the contact portion may be a flexible spring contact arm. The terminal most often includes a base portion which is provided for mounting the terminal in the connector housing. The terminal may include a latching portion for retaining the terminal in the housing. The terminal may include a tail portion projecting from the housing. Quite often, the terminal includes a portion that is engageable by an insertion tool for inserting the terminal into the housing. All of these various components of electrical terminals must be considered in designing a particular electrical connector, and the sheer number of such components or portions of the terminal constantly create problems in electrical connector design.

For instance, in the ever-increasing miniaturization of electrical connectors for compact design of electronic apparatus, the connectors and, in turn, the terminals must be provided in smaller and smaller design envelopes. One area in which this miniaturization causes problems is in providing a portion of the terminal for engagement by an insertion tool for inserting the terminal into the housing. Heretofore, some insertion systems employ tools for contacting an edge of the terminal base either at its lateral edge or, as shown in U.S. Pat. No. 5,338,230, dated Aug. 16, 1994 and assigned the assignee of the present invention, at its central edge between a flexible contact arm and a solder tail. Such a system is quite adequate in certain applications, but the width of the terminal base must be wider to receive the insertion tool at its edge, and this requires a wider housing to receive the wider terminal base. Such a system causes problems in miniaturizing the overall connector.

Another example of an insertion system is shown in U.S. Pat. No. 5,244,414, dated Sep. 14, 1993 and again assigned to the assignee of the present invention. That patent discloses a boardlock with a slot at one end which slidably engages an insertion tool. The insertion tool has a lip designed to contact the rear surface of the boardlock, and the lip requires additional depth and an enlarged housing thickness which, again, inhibits miniaturization of the overall connector.

The present invention is directed to solving some of these problems by providing a unique terminal configuration having a portion to facilitate insertion of the terminal without in any way enlarging the terminal or the terminal housing.

SUMMARY OF THE INVENTION

An object, therefore, of the invention is to provide a new and improved electrical connector of the character described.

In the exemplary embodiment of the invention, the connector includes a dielectric housing having a terminal-receiving passage for insertion thereinto of a terminal in a given insertion direction. The terminal includes a spring contact arm at least in part projecting into the passage for engagement by an appropriate mating contact member. The terminal also includes a tool engagement arm projecting into the passage behind the spring contact arm at a location to provide an engagement shoulder for an insertion tool which forces the terminal into the terminal-receiving passage of the housing. As disclosed herein, the terminal is a unitary structure of stamped and formed sheet metal material. The tool engagement arm is formed by a blade-like element projecting in a plane generally transversely of the given insertion direction to thereby present a planar surface for engagement by the insertion tool. The contact arm forms one leg and the base portion forms the other leg of a generally U-shaped portion of the terminal, and the engagement arm projects toward the spring contact arm from the other leg.

As disclosed herein, the spring contact arm projects through a side opening in the housing for engaging the mating contact member outside the housing. The spring contact arm includes an outwardly bowed contact portion projecting through the opening. The spring contact arm includes a distal end located within the passage and engageable with an interior shoulder of the housing for resiliently preloading the spring contact arm. More specifically, the distal end of the spring contact arm is generally T-shaped, with the cross of the T-shape engageable with the inside of the passage on opposite sides of the opening.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
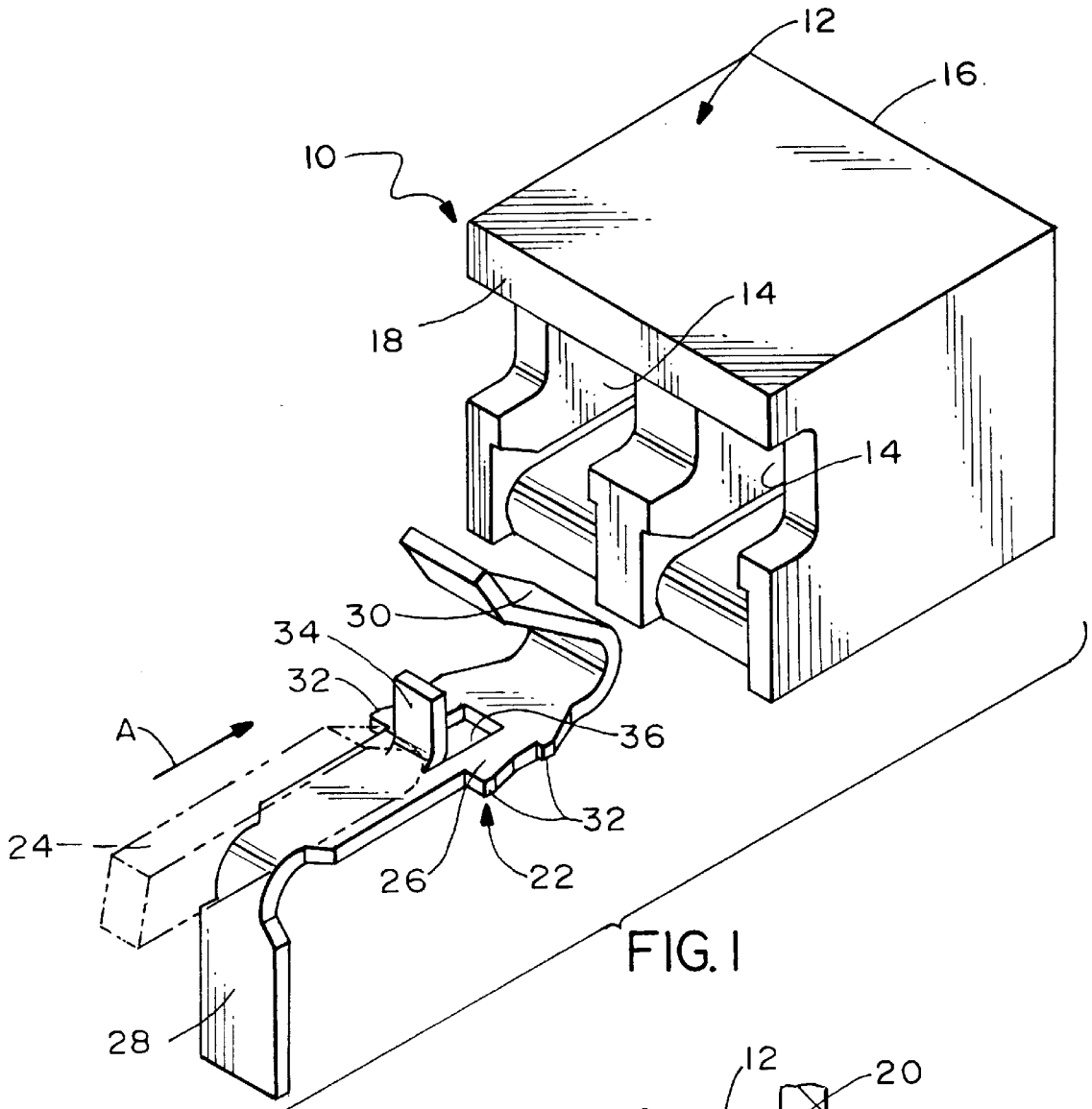
FIG. 1 is a perspective view of one embodiment of an electrical connector, showing the dielectric housing of the connector and one terminal of the connector being inserted into the housing.
Figure 2:
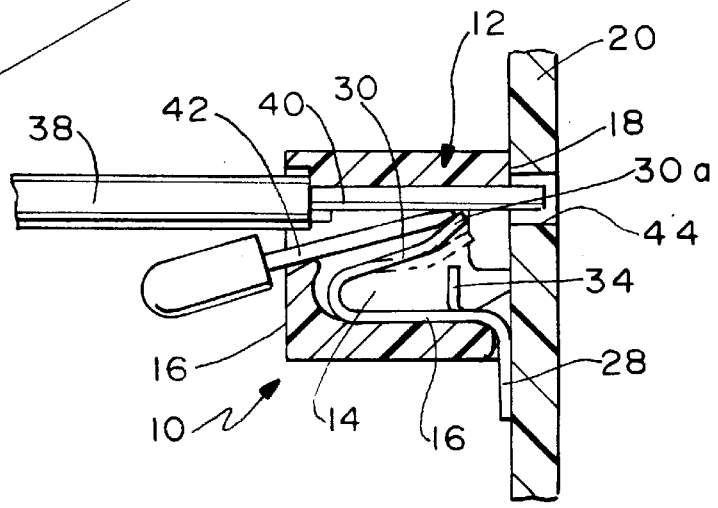
FIG. 2 is a vertical section showing the connector of FIG. 1 receiving a conductor, with a terminating face of the connector surface mounted to a printed circuit board, and with a release tool inserted into the connector.

Referring to the drawings in greater detail, and first to FIGS. 1 and 2, one embodiment of an electrical connector, generally designated 10, incorporates the concepts of the present invention and includes a dielectric housing, generally designated 12, which has a plurality of terminal-receiving passages 14. The housing is unitarily molded of insulating material such as plastic or the like and defines a mating end or face 16 and a terminating end or face 18. Connector 10 is adapted for surface mounting to a printed circuit board 20 as shown in FIG. 2 and described hereinafter.

Connector 10 includes a plurality of terminals, generally designated 22, designed for insertion into passages 14 in the direction of arrow "A" (FIG. 1) by an insertion tool 24 shown in phantom. Although a connector design for two terminals 22 and two passages 14 are shown in the drawings, it is contemplated that the concepts of the invention are applicable for use in electrical connectors having from one to a plurality of terminals more than two thereof.

Connector 10 is configured as a type of "wire trap" connector, and each terminal 22 is stamped and formed of sheet metal material and includes a base or body portion 26 having a tail portion 28 at one end and a cantilevered spring contact arm 30 at the opposite end. It can be seen in FIG. 1 that tail portion 28 is formed perpendicular to base portion 26 for surface connection to an appropriate circuit trace on printed circuit board 20 as shown in FIG. 2. Spring contact arm 30 is reverse formed back over the base portion 26 whereby the base portion and the spring contact arm form a generally U-shaped portion of the terminal within the respective passage, again as clearly seen in FIG. 2. Terminal 22 also is formed with a pair of teeth 32 at each edge of base portion 26 for biting into the plastic material of housing 12 at each side of the respective terminal-receiving passage 14. Lastly, terminal 22 includes an engagement arm 34 stamped and formed out of an opening 36 in base portion 26, such that the engagement arm projects transversely of passage 14 behind cantilevered spring contact arm 30.

Engagement arm 34 of each terminal 22 is unique in that it is located to perform a dual function. First, referring to FIG. 1, it can be seen that the engagement arm is a blade-like element in a plane generally transverse to arrow "A" which defines the insertion direction of the terminal. Therefore, insertion tool 24 can be engaged with the engagement arm to force the terminal into its respective passage 14 in housing 12.

Second, referring to FIG. 2, engagement arm 34 is shown located behind and projecting toward cantilevered spring contact arm 30. An electrical wire 38 with an exposed conductor 40 is shown inserted into passage 14 and into engagement with a contact portion or tip 30*a* of contact arm 30. The tip of the contact arm traps the conductor and prevents its withdrawal. A release tool 42 is shown inserted into passage 14 for releasing the spring contact arm away from conductor 40 and allow removal of the conductor. There is a tendency for an operator to over-bias the spring contact arm and, in turn, overstress the arm and destroy some of the resiliency thereof. The location of engagement arm 34 provides an anti-overstress means for the spring contact arm.

Therefore, it can be seen from the above that engagement arm 34 projects into passage 14 behind cantilevered spring contact arm 30 at a location to perform the dual function of (1) providing an anti-overstress engagement means for the spring contact arm, and (2) providing an engagement shoulder for a insertion tool 24 which forces terminal 22 into the terminal-receiving passage of housing 12.

Another feature of the invention is shown in FIG. 2 wherein it can be seen that passage 14 is open-ended and includes open ends in both the mating face 16 and the terminating face 18 of connector housing 12. Therefore, conductor 40 can be cut to a length to extend completely through the passage. In addition, a system is provided for including a clearance hole 44 in printed circuit board 20 and into which conductor 40 can project beyond the connector.

It should be understood that it is very difficult to cut exposed conductors 40 to precise lengths. Consequently, heretofore the connector housing had to be made sufficiently large to accommodate a substantial length of the conductor therewithin, in order to ensure that the conductor would be properly terminated to the contact arm of the terminal. With the system of the invention, by providing passage 14 as an open-ended passage, spring contact arm 30 can be located near one end or face of the housing, such as terminating face 18, and conductor 40 simply can be cut to a substantial length and project entirely through the housing. Further, the system contemplates that the printed circuit board, itself, include clearance hole 44 to allow the over-insertion of the conductor. This entire concept allows connector housing 12 to be miniaturized at least in the dimension thereof between mating and terminating faces 16 and 18, respectively.

Figure 3:
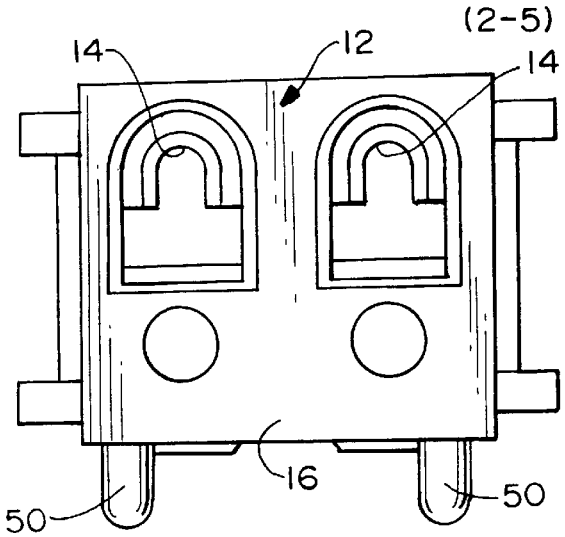
FIG. 3 is a front elevational view of another embodiment of an electrical connector for surface mounting to a printed circuit board at a right-angle to the embodiment of FIGS. 1 and 2.
Figure 4:
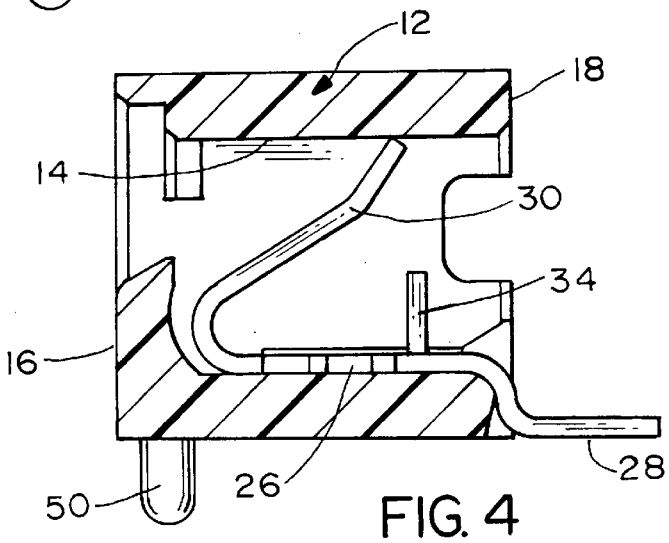
FIG. 4 is a vertical section through the connector of FIG. 3.
Figure 5:
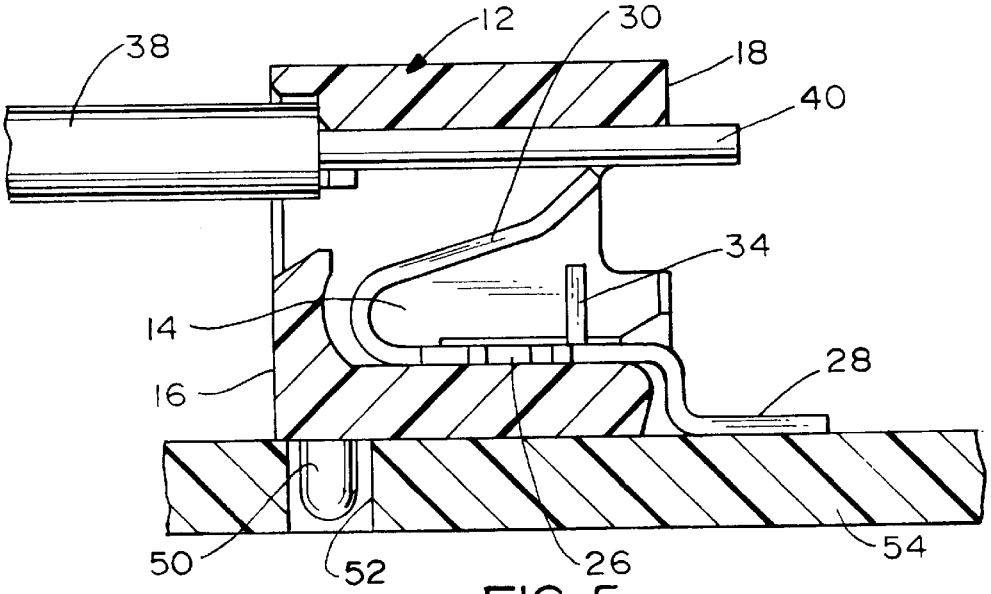
FIG. 5 is a view similar to that of FIG. 4, with the connector mounted to a printed circuit board, and with a conductor inserted into the connector.

FIGS. 3–5 show an alternate embodiment of the invention which is very similar to the embodiment described above in relation to FIGS. 1 and 2. Consequently, like reference numerals have been applied in FIGS. 3–5 corresponding to like elements or components described above in FIGS. 1 and 2.

More particularly, in the embodiment of FIGS. 3–5, the connector housing 12 includes a plurality of mounting feet 50 for mounting within a plurality of mounting holes 52 in a printed circuit board 54. It can be seen that the connector in FIGS. 3–5 is mounted to the printed circuit board at a right-angle relative to the connector shown in FIG. 2.

The only other difference in the connector of FIGS. 3–5 is that the terminals each include a tail portion 28' which is formed for surface mounting to printed circuit board 54 in the right-angled orientation of the connector. In other words, whereas tail portion 28 (FIGS. 1 and 2) projects perpendicular to base portion 26 of the terminal, tail portion 28' (FIGS. 4 and 5) is offset from and extends generally parallel to base portion 26. Otherwise the configuration of the terminal, including cantilevered spring contact arm 30 and engagement arm 34 is identical to terminal 22 described above.

In the embodiment of FIGS. 3–5, like the embodiment of FIGS. 1 and 2, terminal-receiving passages 14 are open-ended so that conductors 40 can be inserted completely through the connector housing as shown in FIG. 5. Therefore, again, contact arm 30 of the terminal can be located very near terminating face 18 of the housing without creating a problem of ensuring that the conductor actually engages the contact arm, since the conductor can be cut to a length to extend considerably beyond the contact arm.

Figure 6:
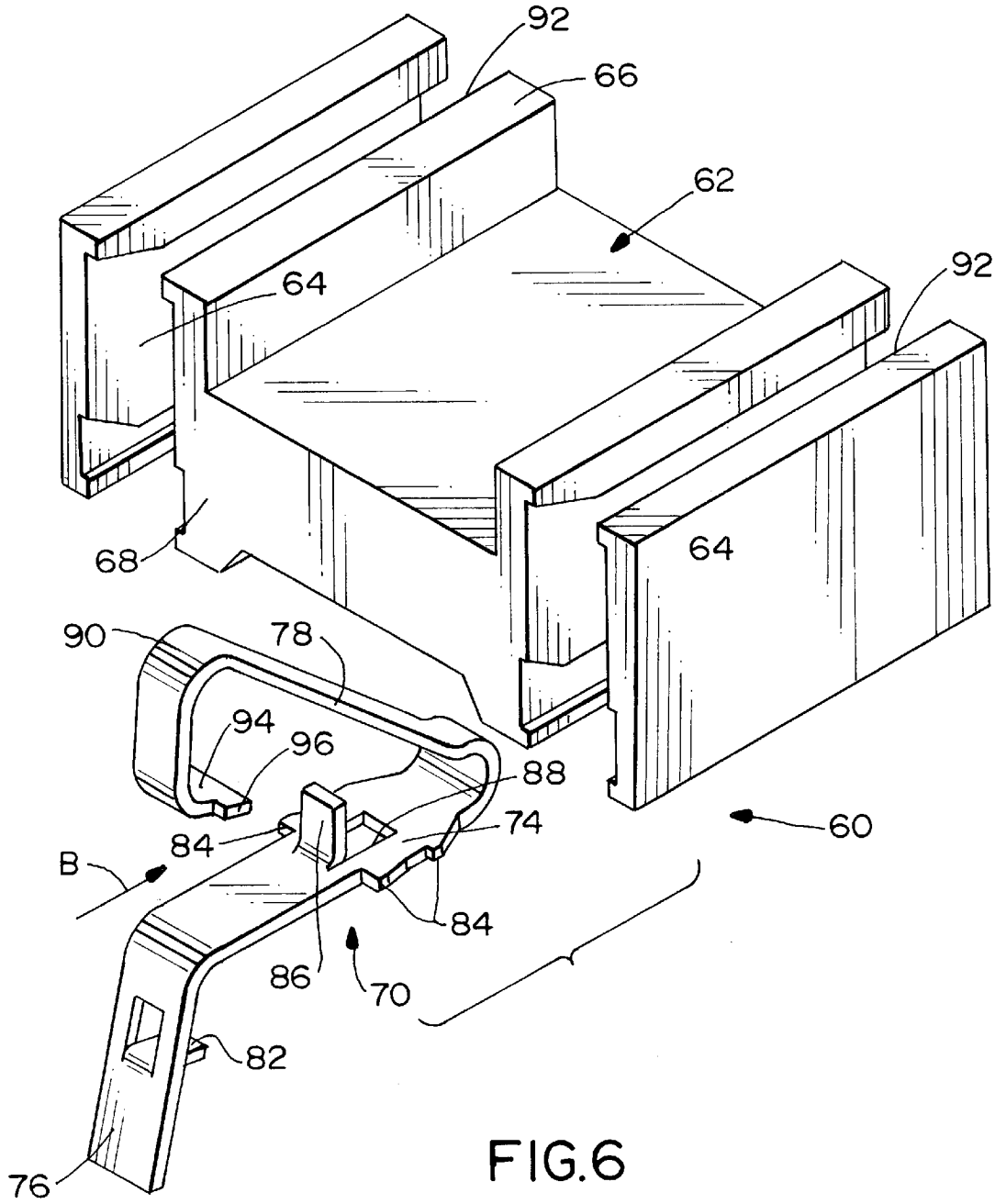
FIG. 6 is a perspective view of still another embodiment of an electrical connector with a terminal incorporating a portion for engagement by an insertion tool.

FIG. 6 shows a further embodiment of an electrical connector, generally designated 60, which includes a dielectric housing, generally designated 62, which has a plurality of terminal-receiving passages 64. Again, the housing is unitarily molded of dielectric or insulating material such as plastic or the like and defines a mating end or face 66 and a terminal end or face 68.

Connector 60 includes a plurality of terminals, generally designated 70, designed for insertion into passages 64 in the direction of arrow "B" by an appropriate insertion tool as shown in phantom at 24 in FIG. 1. Although connector 60 is designed for receiving two terminals, only one terminal is shown, but it is contemplated that the concepts of the invention are applicable for use in electrical connectors having from one to a plurality of terminals more than two thereof.

Figure 12:
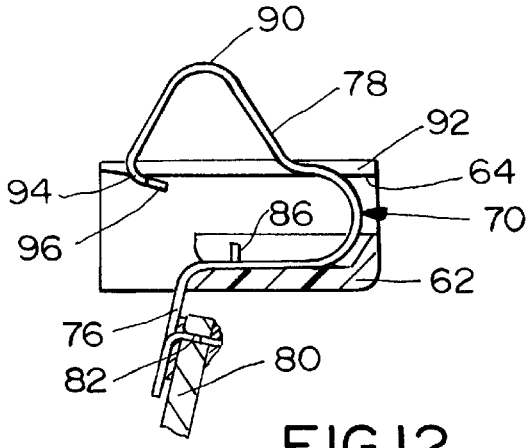
FIG. 12 is a vertical section showing the connector of FIG. 6 ready for final assembly with the terminal fully inserted into the housing and with a printed circuit member mounted thereto.

Each terminal 70 is stamped and formed of sheet metal material and includes a base or body portion 74 having a tail portion 76 at one end and a cantilevered spring contact portion 78 at the opposite end. It can be seen in FIG. 6 that tail portion 76 is formed at an angle to base portion 74 for connection to an appropriate printed circuit member 80 (FIG. 12). In fact, tail portion 76 has a solder tab 82 for solder connection to a conductor of circuit member 80.

Spring contact arm 78 is generally reverse formed back over base portion 74 whereby the base portion and the spring contact arm form a generally U-shaped portion of the terminal. Terminal 70 also is formed with a pair of teeth 84 at each edge of base portion 74 for biting into the plastic material of housing 62 at each side of the respective terminal-receiving passage 64. Terminal 70 includes a tool engagement arm 86 stamped and formed out of an opening 88 in base portion 74, such that the tool engagement arm projects transversely of passage 64 behind cantilevered spring contact arm 78. Actually, the tool engagement arm projects generally perpendicularly inwardly of base portion 74 of the terminal toward the spring contact arm 78.

Lastly, terminal 70 is designed to project outwardly of housing 62 for engagement by a conductor of an appropriate mating contact member, such as on a battery (not shown), and the spring contact arm is preloaded in such a condition. This will be clearly understood from a subsequent description of FIG. 12, but suffice it to say at this point, spring contact arm 78 has an outwardly bowed contact portion 90 that projects through a side opening 92 in housing 62. A distal end 94 of the spring contact arm is generally T-shaped to define a cross portion 96 which is engageable with the housing on the inside of passage 64 on opposite sides of opening 92, as will be seen hereinafter.

Figure 7:
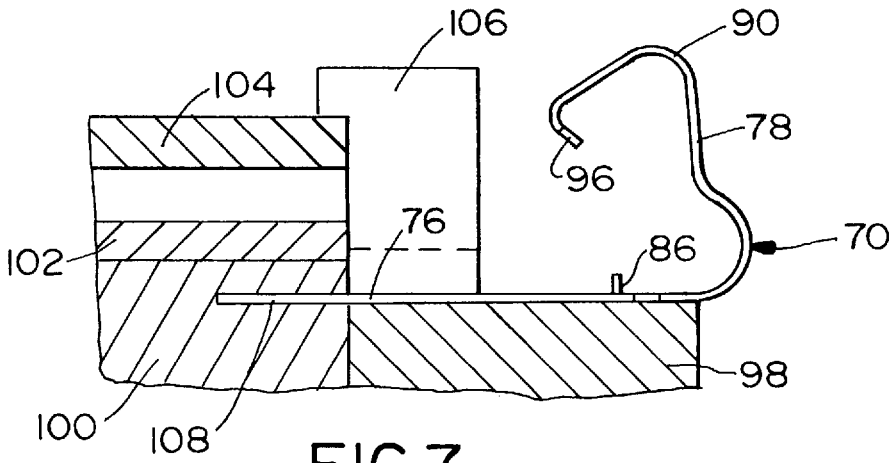
FIGS. 7–11 are sequential views of inserting the terminal of FIG. 6 into its housing and including appropriate tooling therefor.

FIGS. 7–11 are sequential views of the process of inserting one of the terminals 70 into its respective passage 64 of connector housing 62. More particularly, FIG. 7 shows one of the terminals 70 positioned on a punch 98 adjacent a die 100, an insertion tool 102, a stop 104 and a spring loaded stripper 106. The terminal is shown still connected to a carrier or feed strip 108 which carries a plurality of terminals to their processing station(s) with the terminals seriatim along the carrier strip.

Figure 8:
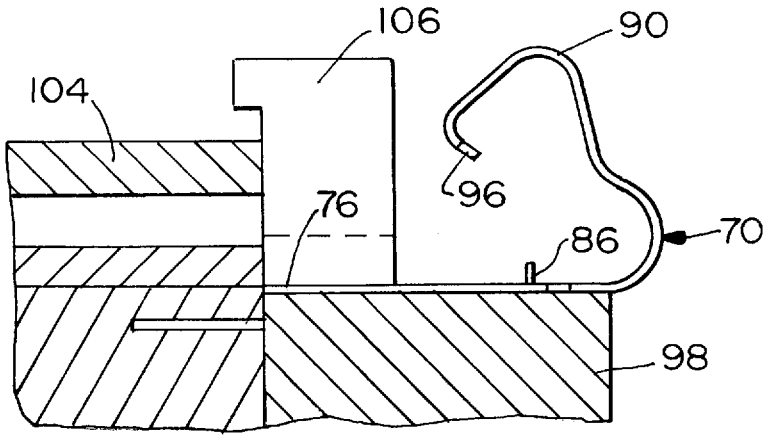

FIG. 8 shows punch 98 having been moved upwardly to shear terminal 70 from carrier strip 108. During this processing step, the terminal is gripped between punch 98 and the lateral edges of stripper 106 on either side of an opening adapted to allow the insertion tool to pass through.

Figure 9:
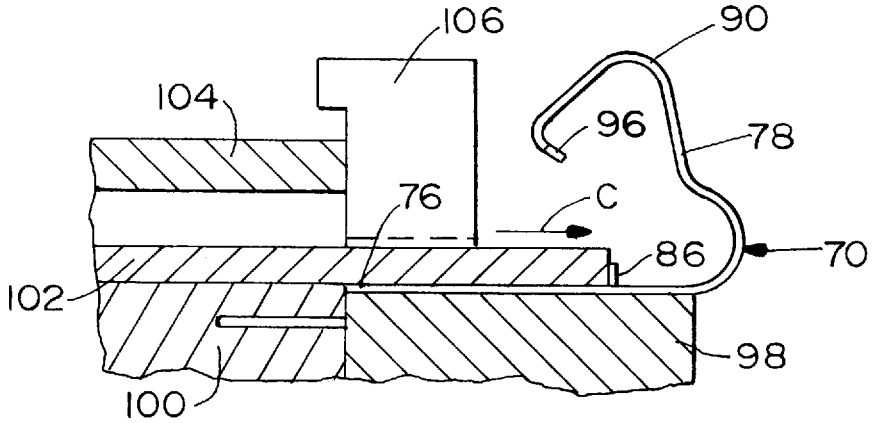

FIG. 9 shows the terminal still being gripped between punch 98 and the lateral edges of stripper 106, but with the insertion tool 102 having been moved forwardly in the direction of arrow "C" through the opening in stripper 106. The insertion tool engages tool engagement arm 86 of the terminal as shown.

Figure 10:
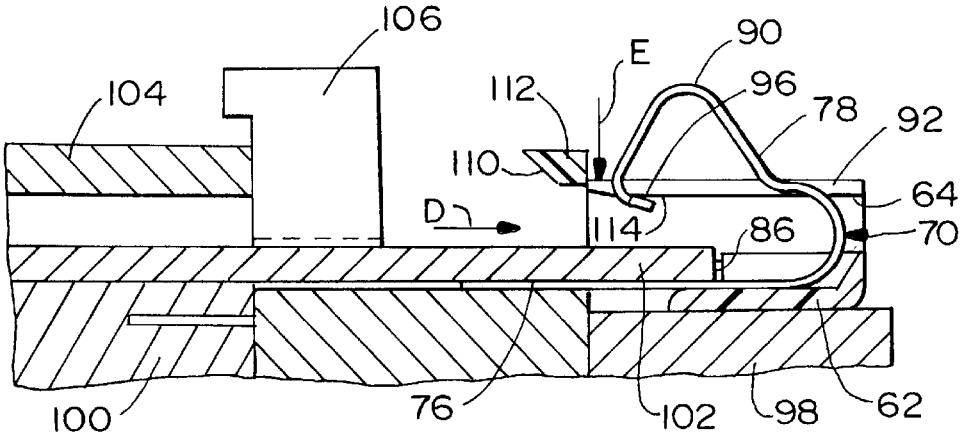

FIG. 10 shows insertion tool 102 having been moved further forwardly in the direction of arrow "D" while engaging tool engagement arm 86 of terminal 70. The terminal has been moved substantially into passage 64 of connector housing 62. As the terminal is inserted into the connector housing, outwardly bowed contact portion 90 of spring contact arm 78 engages a camming surface 110 of an upper wall 112 of the tooling setup. The camming surface effectively biases the spring contact arm downwardly in the direction of arrow "E" during insertion. As the terminal is fully inserted into passage 64 of the connector housing, the spring contact arm clears wall 112 and resiliently moves back outwardly until cross portion 96 of the T-shaped distal end of the spring contact arm engages the inside of passage 64 on opposite sides of opening 92, as at 114. This effectively resiliently preloads the spring contact arm.

Figure 11:
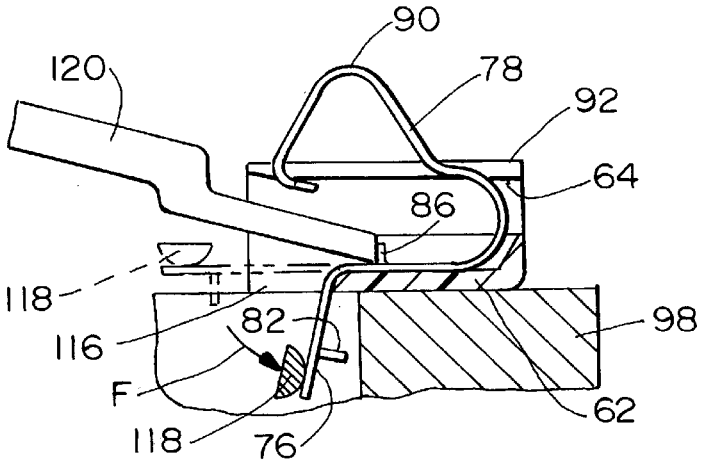

FIG. 11 shows the last processing step wherein tail portion 76 of the terminal is bent downwardly and outwardly through an opening 116 in connector housing 62 by means of a bending tool 118 moving in the direction of arrow "F". During such a bending step, a stabilizing tool 120 engages engagement arm 86 to stabilize the terminal while tail portion 76 is bent downwardly.

Lastly, FIG. 12 shows the connector ready for final assembly on or into another component (not shown) with the terminal 70 fully inserted into connector housing 62, with the outwardly bowed contact portion 90 projecting through opening 92 in the housing, and with the cross 96 of the T-shaped distal end of the spring contact arm resiliently preloading the spring contact arm. Solder tab 82 of tail portion 76 of the terminal is shown connected to a conductor of circuit element 80. FIG. 12 also clearly shows how engagement arm 86 projects inwardly of passage 64 behind spring contact arm 78 and, thereby, does not require any enlargement whatsoever of the connector housing in order to provide means on the terminal to facilitate insertion of the terminal into the housing by an insertion tool.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for removably connecting a conductor of a mating contact member to a printed circuit member comprising:

a dielectric housing having an elongated terminal receiving passage and an opening communicating with the passage; and an integrally formed terminal, adapted to be inserted into the passage including a base, a spring contact arm extending from and overlying said base having, an outwardly bowed contact portion, adapted to protrude through the opening when the terminal is fully inserted in the passage, for electrically engaging the conductor of the mating contact member, and a section of the spring contact arm adjacent a free end portion being bent so that the free end portion is located generally between the bowed portion of the spring contact arm and the terminal base, the free end portion having a T-shaped section with laterally extending arms contacting an interior shoulder of the passage adjacent the opening for preloading the spring contact arm, an upstanding tool engagement arm stamped from the base and adapted to be contacted by an insertion tool so that the tool can force the terminal into the terminal insertion cavity, and a mounting end extending from the base and adapted to be electrically connected to the printed circuit member.

2. In an electrical connector which includes a dielectric housing having a terminal-receiving passage for insertion thereinto of a terminal in a given insertion direction, the terminal including a base portion and spring contact arm forming a generally U-shape, and the spring contact arm at least in part projecting into the passage and having a portion projecting through a side opening in the housing for engagement by a conductor of an appropriate mating contact member outside the housing, said terminal comprising a unitary structure of stamped and formed sheet metal material and including a tool engagement arm projecting toward the spring contact arm from the base portion into the passage at a location to provide an engagement shoulder for an insertion tool which forces the terminal into the terminal-receiving passage of the housing, said spring contact arm including a portion adjacent a distal end being bent so that the distal end is located within the passage generally between the portion of the spring contact arm projecting through the side opening and the terminal base, the distal end engageable with an interior shoulder of the terminal receiving passage for resiliently preloading the spring contact arm.

3. In an electrical connector as set forth in claim 2, wherein said engagement arm comprises a blade-like element projecting in a plane generally transversely of said given insertion direction to thereby present a planar surface for engagement by the insertion tool.

4. In an electrical connector as set forth in claim 2 wherein said spring contact arm includes a bowed portion projecting though said opening.

5. In an electrical connector as set forth in claim 2, wherein said distal end of the spring contact arm is generally T-shaped with the cross of the T-shape engageable with the inside of the passage on opposite sides of said opening.

* * * * *